US010384249B2

(12) United States Patent
Denkmeier

(10) Patent No.: US 10,384,249 B2
(45) Date of Patent: Aug. 20, 2019

(54) HANDLING SYSTEM FOR BENDING TOOLS

(71) Applicant: TRUMPF Maschinen Austria GmbH & Co. KG., Pasching (AT)

(72) Inventor: Thomas Denkmeier, Traun (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 288 days.

(21) Appl. No.: 15/517,563

(22) PCT Filed: Oct. 8, 2015

(86) PCT No.: PCT/AT2015/050249
§ 371 (c)(1),
(2) Date: Apr. 25, 2017

(87) PCT Pub. No.: WO2016/054668
PCT Pub. Date: Apr. 14, 2016

(65) Prior Publication Data

US 2017/0239701 A1 Aug. 24, 2017

(30) Foreign Application Priority Data

Oct. 8, 2014 (AT) ..... A 50718/2014

(51) Int. Cl.
*B21D 5/02* (2006.01)

(52) U.S. Cl.
CPC ..... *B21D 5/0254* (2013.01)

(58) Field of Classification Search
CPC ..... B21D 5/02; B21D 5/0209; B21D 5/0254; B21D 11/22; B21D 37/04; B21D 37/14
See application file for complete search history.

(56) References Cited

U.S. PATENT DOCUMENTS 4,315,425 A * 2/1982 Zbornik ..... B21D 5/0209 72/462
6,644,090 B2 11/2003 Gasparini
(Continued)

FOREIGN PATENT DOCUMENTS

EP 1 160 024 A1 12/2001
EP 2 498 928 B1 2/2014
(Continued)

OTHER PUBLICATIONS

International Search Report of PCT/AT2015/050249, dated Feb. 29, 2016.

*Primary Examiner* — Teresa M Ekiert
(74) *Attorney, Agent, or Firm* — Collard & Roe, P.C.

(57) ABSTRACT

The invention relates to a tool handling system (1) for removing or inserting a bending tool (2) in a tool mounting (3), comprising a bending tool (2) having a gripping recess (16) and a locking device (7) that cooperates with the tool mounting (3), the locking device being deactivatable by an actuating element (10) which is arranged in the gripping recess (16) and is accessible therein, and further comprising a gripper (11) with a gripper base body (12), comprising a first gripper finger (14) arranged on the gripper base body and at least a second gripper finger (15) which is adjustable on the gripper base body (12) by means of an articulation (20). The invention is characterized in that the first gripper finger (14), when positioned in the gripping recess (16), and the adjustable second gripper finger (15), when positioned in a release position, do not contact the actuating element (10) and that the adjustable second gripper finger (15) contacts the actuating element (10) in a gripping position.

14 Claims, 4 Drawing Sheets

(56) References Cited

U.S. PATENT DOCUMENTS

| | | | | |
|---|---|---|---|---|
| 7,029,429 | B2 | 4/2006 | Akami et al. | |
| 7,721,586 | B2 * | 5/2010 | Pabich | B21D 5/0209 72/389.4 |
| 9,339,860 | B2 | 5/2016 | Denkmeier | |
| 10,144,045 | B2 * | 12/2018 | Mayrhofer | B21D 5/0236 |
| 2013/0327104 | A1 | 12/2013 | Haselboeck | |
| 2015/0258594 | A1 | 9/2015 | Sato | |

FOREIGN PATENT DOCUMENTS

| | | | |
|---|---|---|---|
| WO | 01/39906 | A1 | 6/2001 |
| WO | 2011/057312 | A1 | 5/2011 |
| WO | 2012/103565 | A1 | 8/2012 |
| WO | 2013/116886 | A1 | 8/2013 |
| WO | 2013/166538 | A1 | 11/2013 |
| WO | 2014/061773 | A1 | 4/2014 |

* cited by examiner

HANDLING SYSTEM FOR BENDING TOOLS

CROSS REFERENCE TO RELATED APPLICATIONS

This application is the National Stage of PCT/AT2015/050249 filed on Oct. 8, 2015, which claims priority under 35 U.S.C. § 119 of Austrian Application No. A 50718/2014 filed on Oct. 8, 2014, the disclosure of which is incorporated by reference. The international application under PCT article 21(2) was not published in English.

The invention relates to a tool handling system for removing or inserting a bending tool on a tool mounting according to the preamble of claim 1 and a method for removing or inserting a bending tool on a tool mounting according to the preamble of claim 14.

Bending tools for bending machines are already known from the prior art, which are suitable for performing an automated tool exchange by means of handling devices. As such bending tools are often equipped with locking systems which prevent them from falling out of a tool mounting of the bending machine unintentionally, such a tool handling system also has to be able to manage the activation and deactivation of the locking system.

An example of such a tool handling system is known for example from WO 2013/116886 A1. In the tool handling system disclosed therein the locking system is deactivated when the handling device picks up a bending tool. The clamping of the bending tool in the tool mounting thus has to remain activated until the bending tool has been completely picked up, as otherwise the not yet completely gripped bending tool may otherwise fall out in an uncontrolled manner, as the locking device can be deactivated before the completion of the picking up process. If by means of such a tool handling system several bending tool have to be removed or inserted, the tool clamping has to be activated or deactivated multiple times which may result in displacements in the position of the bending tools inside the tool clamp and the automatic handling and positioning may be made more difficult as a result.

The objective of the invention is to provide a tool handling system, by means of which automated fitting processes on bending machines can be performed more simply and effectively.

The objective of the invention is achieved by means of a tool handling system according to claim 1. Since with a first gripper finger positioned fully in the gripping recess said first gripper finger and the adjustable second gripper finger in its release position do not contact the actuating element arranged in the gripping recess and accessible in the latter or do not deactivate the locking device, and the adjustable second gripper finger in the gripping position contacts the actuating element or deactivates the locking device, it is ensured that it is not possible for the bending tool to fall out unexpectedly during the picking up process, even when the clamping of the tool mounting is not activated during the picking up.

The first gripper finger is thereby arranged in particular above the adjustable second gripper finger and is positioned firstly in the gripping recess and the undercut, whereby the bending tool is already protected from falling out, if as a result the actuating element for the deactivation of the locking system is contacted and thus the clamping of the tool is already inactive.

The invention also relates to grippers which do not have a fixed gripper finger, but have at least two adjustable gripper fingers, which can be adjusted between a release position and a gripping position, wherein one of the gripper fingers can be adjusted independently of the other gripper fingers in its gripping position and at least one further gripper finger is adjusted consecutively into the gripping position. In connection with the method performed by the tool handling system a gripper finger adjusted previously into the gripping position is comparable with the first, in particular fixed, gripper finger.

In an advantageous embodiment of the tool handling system the end surface of the adjustable second gripper finger is set back by an offset in the release position relative to the end surface of the first gripper finger as viewed in the direction of the gripper longitudinal axis. In this way the first gripper finger can be moved fully into the position required for picking up the bending tool in the gripping recess, without the adjustable second gripper finger already contacting the actuating element. The offset is here preferably greater than the activating movement of the actuating element required for the deactivation of the locking system.

The complete introduction of the first gripper finger into the gripping recess, without the latter contacting the actuating element, is facilitated if the end section of the first gripper finger on its end surface comprises a recess for the actuating element. By adjusting the recess to the actuating element there is also a greater freedom of design with regard to its shaping and positioning.

An easily achievable embodiment of the tool handling system consists of designing the gripping recess as a gripping groove and having the undercuts running along the gripping groove, and the gripping projections are designed to be parallel to one another and strip-like and run perpendicular to the gripper longitudinal axis.

An embodiment, which is also suitable for the manual handling of the bending tools, is characterized in that the actuating element is arranged in the gripping recess, in particular approximately centrally, between the undercuts and the actuating direction of the actuating element coincides with the gripper longitudinal direction. The actuating element can be operated in this case by pushing with a finger and in this way the locking device can be deactivated.

It is possible to avoid the premature deactivation of the locking system by contact with a gripper finger, if the actuating element is arranged one of the undercuts. If the actuating element is arranged in an upper undercut, the bending tool on contact with the first gripper finger already depends on the latter, in case the clamping of the bending tool in the tool mounting is deactivated.

It is possible to revert to tried and tested structural designs and drive concepts if the adjustable second gripper finger is mounted by means of a pivot joint about a pivot axis on the gripper base body. The tip of the adjustable gripper finger moves when gripping or releasing on a movement path, which is dependent on the position of the pivot axis. The greater the length of the gripper finger from its pivot axis to its tip the more the movement path is like a straight line.

Alternatively, the adjustable second gripper finger can be mounted by means of a slide joint obliquely in relation to the longitudinal axis on the gripper base body, wherein the linear movement path of the gripper fingertip is determined by the alignment of the slide joint.

For contacting the actuating element it can be advantageous if the adjustable second gripper finger comprises an actuating extension, which projects in the release position into a recess on the first gripper finger. An end section of the adjustable gripper finger extended in this way also ensures reliable contact in the gripping position even with an actuating element with small dimensions or particular positioning.

An embodiment in which the gripping projections are designed to be parallel to one another and strip-like and the undercuts are designed to be parallel to one another and to have dovetail shape, results in a tool handling system which is tolerant to small positioning errors of the gripper and is thereby suitable for handling devices with less positioning accuracy.

If the offset of the adjustable gripper finger in the release position relative to the end surface of the fixed gripper finger corresponds at least to a thickness dimension of the gripping projections in the direction of the gripper longitudinal axis, when introducing the fixed gripper finger into the gripping recess there is a sufficient distance between the adjustable gripper finger and the actuating element, so as not to prematurely deactivate the locking system.

There is greater tolerance to the inaccurate positioning of the tool handling system if a centering projection is formed on the fixed gripper finger and a centering recess is formed on the bending tool. The threading of the gripper fingers into the gripping recess can be facilitated thereby in horizontal and/or vertical direction.

If the adjustable gripper finger has an offset bend in the direction of the fixed gripper finger, the gripper can also have a small distance between the gripper fingers even with comparatively large external dimensions.

The invention also relates to a method for removing or inserting a bending tool on a tool mounting by means of a gripper according to the preamble of claim 14. In this case the bending tool comprises a gripping recess and a locking device interacting with the tool mounting, which locking device can be deactivated by an actuating element arranged in the gripping recess, and wherein the gripper comprises at least one, in particular fixed, first gripping finger aligned in the direction of a gripper longitudinal axis, and an adjustable second gripping finger, which on their end sections relative to the gripper longitudinal axis comprise transversely outwardly pointing and approximately opposite gripping projections for undergripping opposite undercuts in the gripping recess.

The handling of the bending tool is improved according to the invention in that when removing the bending tool firstly the first gripper finger is moved into full engagement with an undercut and thereby the adjustable second gripper finger does not contact the actuating element or does not deactivate the locking device and afterwards the adjustable second gripper finger is moved into engagement with the further undercut and thereby contacts the actuating element or deactivates the locking device and when inserting the bending tool the adjustable second gripper finger is moved out of engagement with the further undercut and in this way the actuating element is no longer contacted and the locking device is activated and afterwards the first gripper finger is moved out of engagement with the undercut of the gripping groove.

For a better understanding of the invention the latter is explained in more detail with reference to the following Figures.

In a much simplified, schematic representation in the latter:

Figure 1:
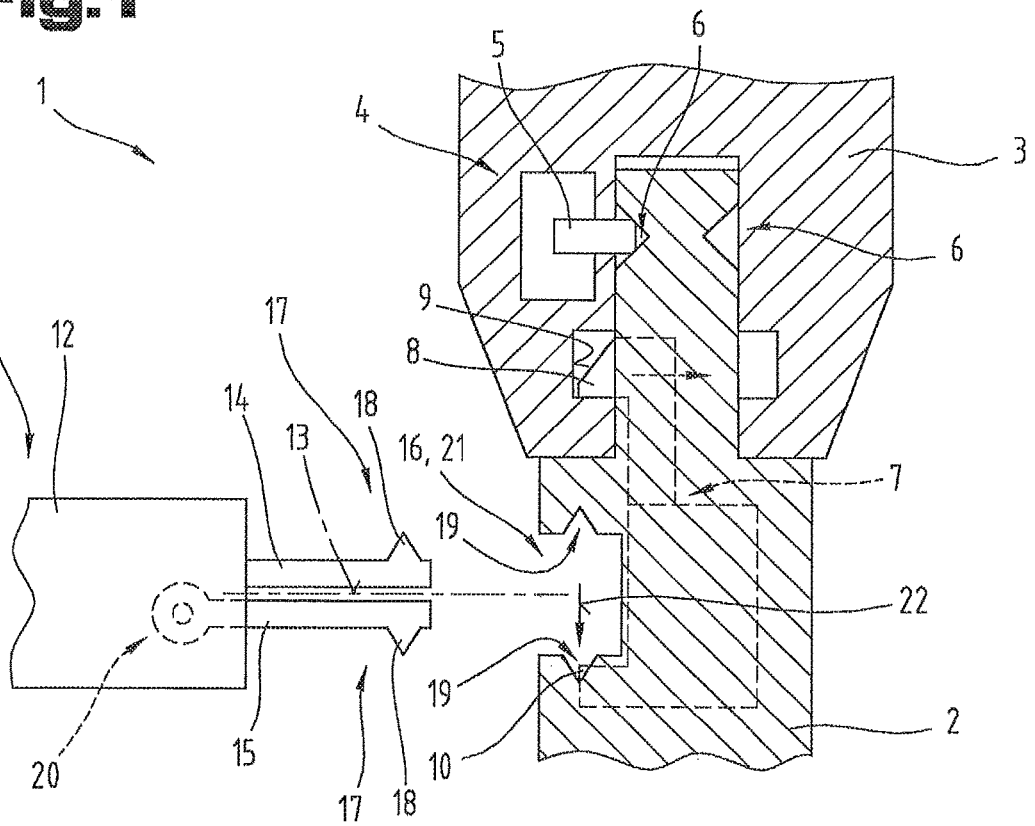
FIG. 1 shows a view of a tool handling system with gripper fingers positioned in front of the gripping groove in release position.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a view of a tool handling system 1 for removing or inserting a bending tool 2 on a tool mounting 3. The tool mounting 3 is for example a component of a not shown bending machine or of a storage system for bending tools 2.

Bending tools 2, which are inserted from below into a tool mounting 3, are usually fixed by means of a fixing device 4 in a receiving groove of the tool mounting 3, for which reason the fixing device 4 can comprise a clamping element 5 for example, which interacts with clamping recesses 6 on the bending tool 2. As in order to change a bending tool 2 the fixing device 4 has to be deactivated, bending tools 2 are often provided with a locking device 7, which prevents the bending tool 2 falling out unintentionally when deactivating the fixing device 4. In the shown example embodiment the locking device 7 comprises for example an adjustable locking element 8, which with the inserted bending tool 2 engages in a form-fitting manner in a locking recess 9 in the tool mounting 3 and is only moved out of engagement with the locking groove 9 on the deactivation of the locking device 7 (indicated by a dash-dot arrow) and thereby the bending tool 2 can be moved in a downwards direction.

For deactivating the locking device 7 the latter comprises an actuating element 10, which is arranged outside the tool mounting 3 and by means of which on the locking element 8 it is possible to change between a locking position and an unlocking position.

For the automated removal or insertion of the bending tool 2 the tool handling system comprises a gripper 11 for manipulating the bending tool 2, which also performs the task of activating the actuating element 10.

The gripper 11 is arranged on a not shown manipulator, for example an industrial robot and comprises a gripper base body 12, from which at least two gripper fingers 14 and 15 emerge in the direction of a gripper longitudinal axis 13, which can be positioned in a gripping recess 16 on the bending tool 2. In order to ensure the secure picking up of a bending tool 2, the gripper fingers 14, 15 have gripping projections 18 on their end sections 17, which in relation to the gripper longitudinal axis 13 are directed outwards perpendicularly, are arranged approximately opposite and are suitable for gripping into opposite undercuts 19 in the gripping recess 16.

The actuating element 10 is arranged in the gripping recess 16 and is accessible in the latter for at least one gripper finger 14, 15.

On the gripper 11 a first gripper finger 14 is arranged on the gripper base body 12, which in particular is fixed, and at least one second gripper finger 15 can be adjusted by means of an articulation 20 relative to the gripper base body 12 and thus also relative to the first gripper finger 14. In the following a position of the adjustable second gripper finger 15 close to the first gripper finger 14 is referred to as a release position, as in this position the gripper 11 can be released from the bending tool 2 and a position of the adjustable second gripper finger 15 remote from the first gripper finger 14 is referred to as a gripping position, as in this position the bending tool 2 is gripped by the gripper 11. FIG. 1 shows the gripper fingers 14, 15 in release position and the latter can be introduced into the gripping recess 16 on the bending tool 2 and removed from the latter.

The first gripping finger 14 is represented in the example embodiments as being fixed onto the gripper base body 12, however it can also be adjustable, as mentioned above.

When removing the bending tool 2 from the tool mounting 3 the gripper 11 is positioned so that the gripping projection 18 of the first gripper finger 14 is introduced into the upper undercut 19 in the gripping recess 16. As can be seen from the dimensions of the gripper fingers 14, 15 compared to the dimension of the gripping recess 16, the adjustable second gripper finger 15 in release position does not contact the actuating element 10 arranged in the bottom undercut 19, and the locking device 7 is still activated, although the first gripper finger 14 is already in engagement with the gripping recess 16. Only by adjusting the adjustable second gripper finger 15 into the gripping position, in which the gripping projection 18 of the second gripper finger 15 engages in the lower undercut 19, is the actuating element 10 activated and thereby the locking device 7 deactivated. The deactivation of the locking device 7 is performed only at a time at which the bending tool 2 is already connected to the gripper 12 and with such a tool handling system 1 the fixing device 4 for the bending tool 2 can be deactivated before being picked up by the gripper 11, as the bending tool 2 is prevented from falling out by the locking device 7 which remains active until the picking up process. According to the invention then the actuating element 10 in the release position of the adjustable second gripper finger 15 is not in contact and the locking device 7 remains active and in the gripping position of the adjustable second gripper fingers 15 contacts the actuating element 10 and thereby deactivates the locking device 7.

The articulation 20 is formed in the example embodiment according to FIG. 1 by a pivot joint, however it can also be replaced by a slide joint or other articulation, by means of which the adjustable gripper finger 15 can be adjusted between the release position and the gripping position. Of course, the adjustable second gripper finger 15 is also connected to an adjusting drive, which for simplicity is not shown or explained in more detail at this stage.

The gripping recess 16 can have various different forms, whereby a design as a gripping groove 21 is advantageous, which extends in the direction of view according to FIG. 1. An alternative embodiment is for example a pot-like design of the gripping recess 16.

In the example embodiment according to FIG. 1 the adjusting direction of the adjustable second gripper finger 15 is at right angles perpendicular to the gripper longitudinal axis 13 and an arrow indicates the actuating direction 22 of the actuating element 10.

The locking element 8 is designed to be hook-like in the example embodiment according to FIG. 1, but it can also have a different shape, for example it can be plug-like or bolt-like.

Figure 2:
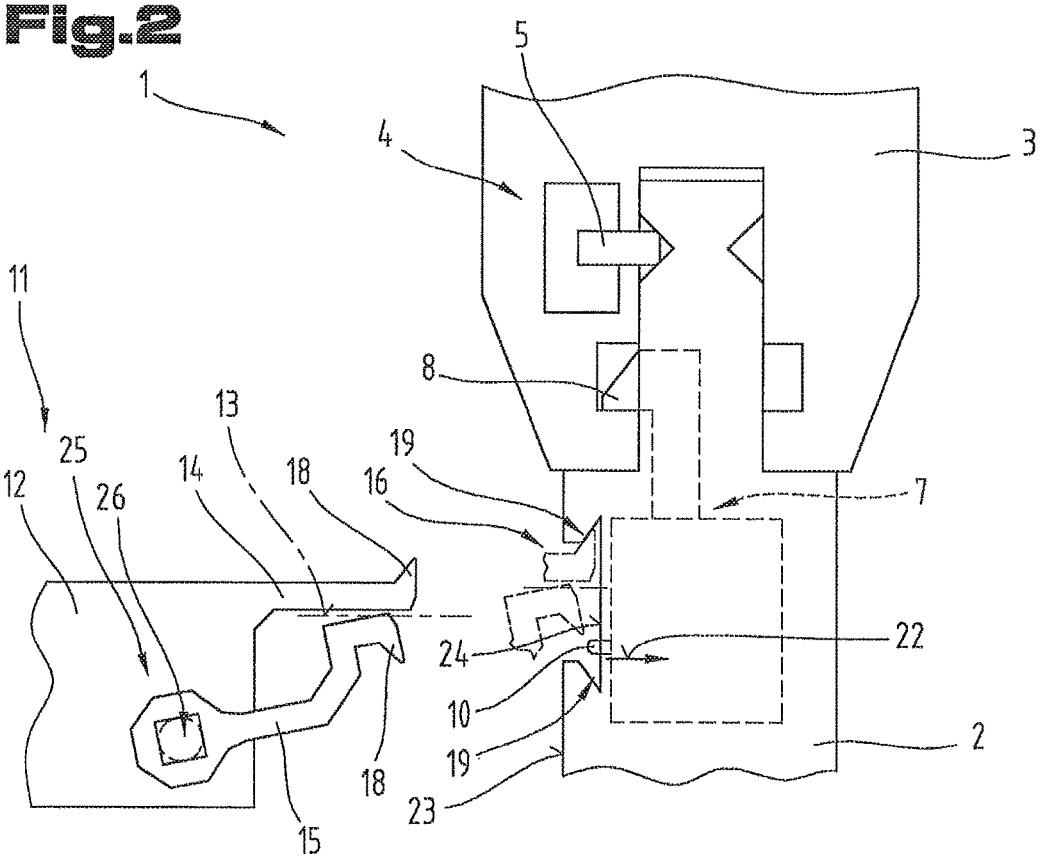
FIG. 2 shows a further embodiment of a tool handling system with gripper fingers positioned in front of the gripping groove in release position.
Figure 3:
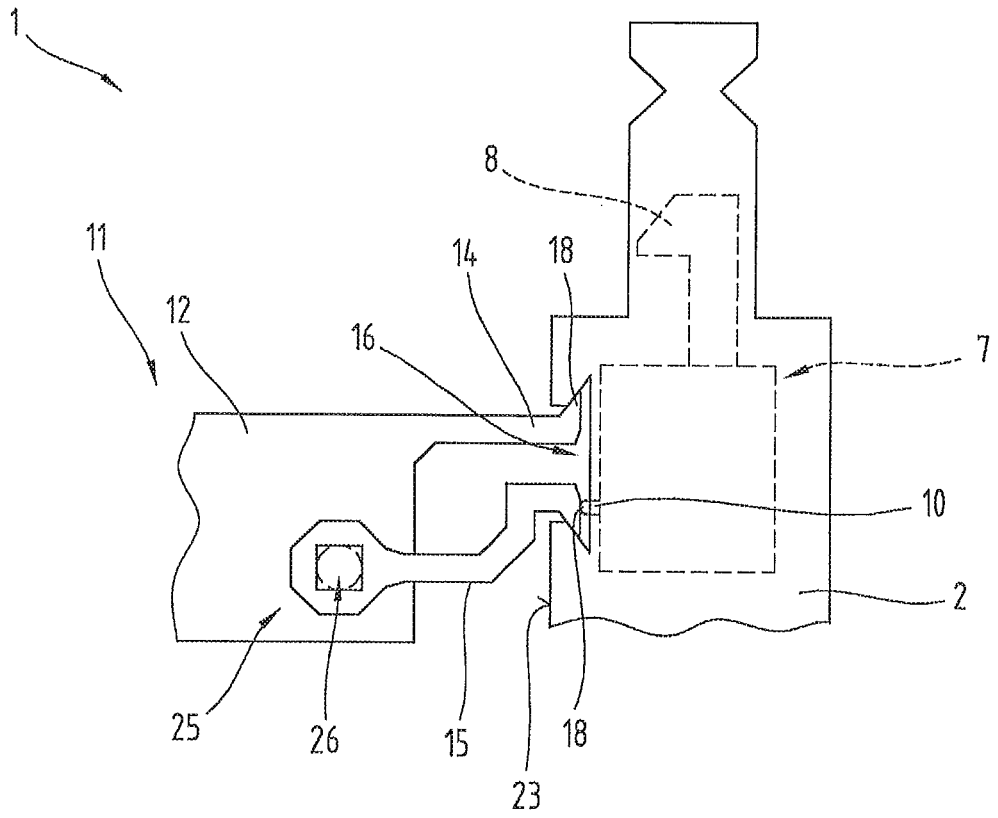
FIG. 3 shows a view of the tool handling system according to FIG. 2 with gripper fingers positioned in the gripping groove in gripping position.

FIGS. 2 and 3 show a further embodiment of a tool handling system 1 according to the invention, wherein FIG. 2 shows with solid lines the gripper fingers 14 and 15 positioned in front of the gripping recess 16 in release position, and with dashed lines the gripper fingers 14, 15 positioned in the gripping recess 16 in release position and in FIG. 3 the gripper fingers 14, 15 are shown in a gripping position.

The gripping recess 16 with the undercuts 19 has a dovetail-shaped cross-section and can also be designed to be pot-like or groove-like.

With a gripping recess 16 in the form of a dovetail groove the bending tool 2 in the gripping recess 16 has a groove base 24 parallel to an outer tool surface 23 and the groove cross-section decreases in the direction of the outer tool surface 23, whereby triangular undercuts 19 are formed. In the shown embodiment the actuating element 10 is arranged between said undercuts 19 and the actuating direction 22 and the adjusting direction of the actuating element 10 runs parallel to the gripper longitudinal axis 13.

FIG. 2 shows with dashed lines the positioning of the gripper fingers 14, 15 in the gripping recess 16 and it can be seen that when engaging the first gripper finger 14 in the upper undercut 19 the adjustable second gripper finger 15 in a release position does not contact the actuating element 10 and therefore in this position the gripper finger 14, 15 of the locking device 7 is active, whereby the bending tool 2 is prevented from falling out even with a deactivated fixing device 4. The actuating direction 22 of the actuating element 10 does not coincide in this example embodiment with the adjusting direction of the adjustable gripper finger 15, as is the case for example in the design according to FIG. 1. The adjustment of the adjustable second gripper finger 15 is performed in this example embodiment similarly to FIG. 1 by means of a pivot joint 25, whereby a pivot axis 26 is formed on the gripper base body 11, 12.

FIG. 3 shows the bending tool 2 held by the gripper 11, wherein the gripper fingers 14, 15 are located in gripping position and in this way the actuating element 10 is contacted by the adjustable gripper finger 15 and furthermore in this way the locking device 7 is deactivated. In the shown example embodiment in this way the locking element 8 is adjusted inside the bending tool 2 and the latter can therefore be taken out of the tool mounting 3.

The adjustable gripper finger 15 has in this example embodiment an offset bent form, whereby the gripper fingers 14, 15 can be inserted into small gripping recesses 16, and on the gripper base body 12 have a comparatively greater distance apart than at their end section 17, whereby in the gripper base body 12 there is enough space for connecting the adjustable gripper fingers 15 to a suitable drive.

Figure 4:
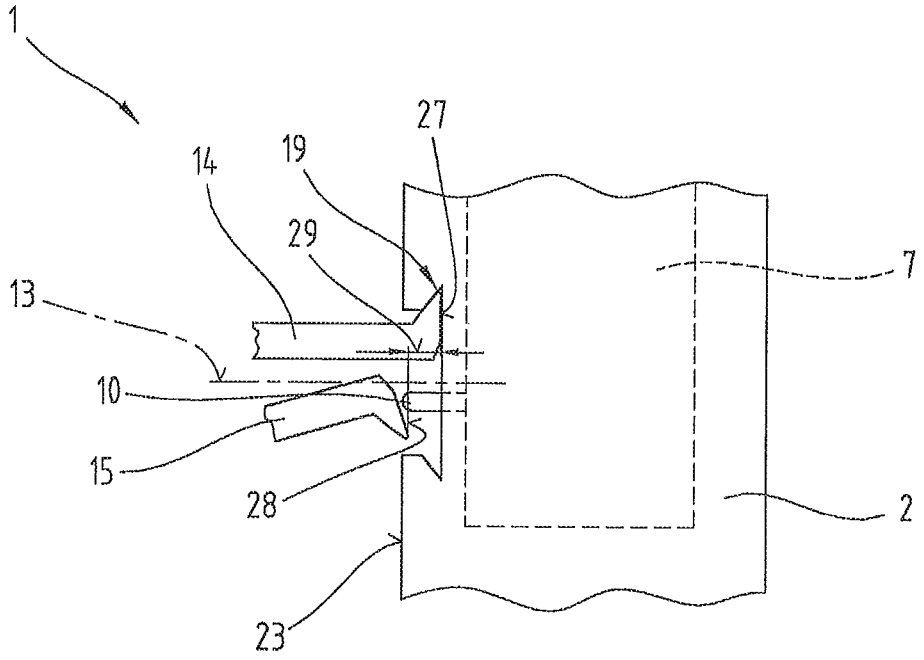
FIG. 4 shows a further embodiment of a tool handling systems with an offset of the adjustable second gripper finger in release position.

FIG. 4 shows a cut-out of a further embodiment of a tool handling system 1, in which the first gripper finger 14 has already been inserted into the upper undercut 19 of the gripping recess 16 of a bending tool 2 and the adjustable second gripper finger 15 located in a release position does not contact the actuating element. In this embodiment this is achieved in that between the end surface 27 of the first gripper finger 14 and the end surface 28 of the adjustable second gripper finger 15 in the release position as viewed in the direction of the gripper longitudinal axis 13 an offset 29 is formed in order to set back the adjustable gripper finger 15 in the release position relative to the first gripper finger 14. In this way the first gripper finger 14 can be threaded with its gripping projection 18 into the upper undercut 19, without the adjustable second gripper finger 15 contacting the actuating element 10 and causing a premature deactivation of the locking device 7. The deactivation of the locking device 7 is only performed when adjusting the second gripper finger 15 into the gripping position, whereby the actuating element 10 is also activated.

FIG. 4 shows a further, optional feature, according to which the offset 29 of the adjustable gripper finger 15 is greater relative to the first gripper finger 14 than a thickness dimension of the gripping projection 18 of the first gripper fingers 14 in the direction of the gripper longitudinal axis 13. In this way for many embodiments of the actuating element 10 there is a sufficiently larger offset 29 and it is ensured in this way that when positioning the first gripper finger 14 in the gripping recess 16 the actuating element 10 is not triggered prematurely.

Figure 5:
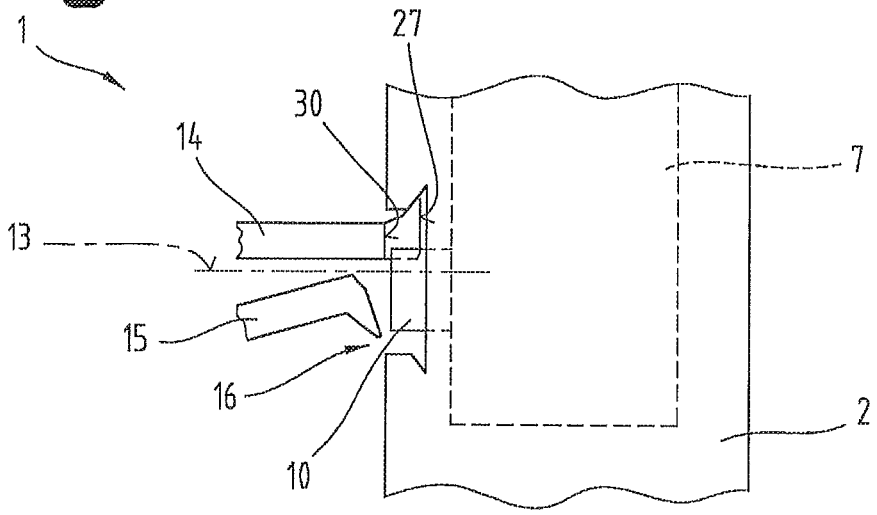
FIG. 5 shows a further embodiment of a tool handling system with a recess in the first gripper finger.

FIG. 5 shows a similar embodiment of a tool handling system 1 as in FIG. 4, in which the adjustable second gripper finger 15 in release position also has an offset relative to the first gripper finger 14 in the direction of the gripper longitudinal axis 13. As an additional feature the first gripper finger 14 comprises in its face end surface 27 a recess 30 for the actuating element 10, whereby the first gripper finger 14 also does not contact an actuating element 10 with larger dimensions when threading into the gripping recess 16.

Figure 6:
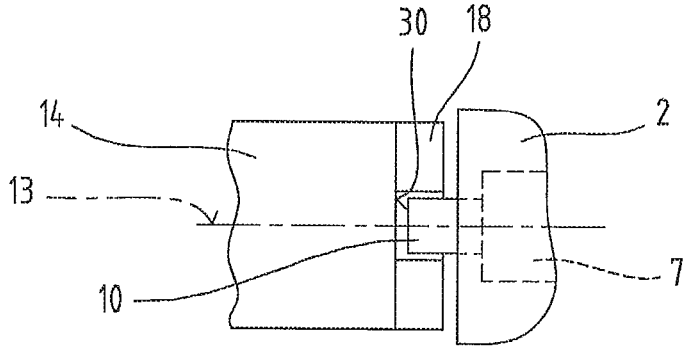
FIG. 6 shows a plan view of the tool handling system according to FIG. 5.

FIG. 6 shows in plan view an arrangement according to FIG. 5, in that the recess 30 on the first gripper finger 14 in this embodiment has larger dimensions than the actuating element 10 and in this way even with slightly inaccurate positioning of the gripper 11 there is no undesirable deactivation of the locking device 7. The first gripper finger 14 has a forked shape and grips laterally next to the actuating element 10.

Figure 7:
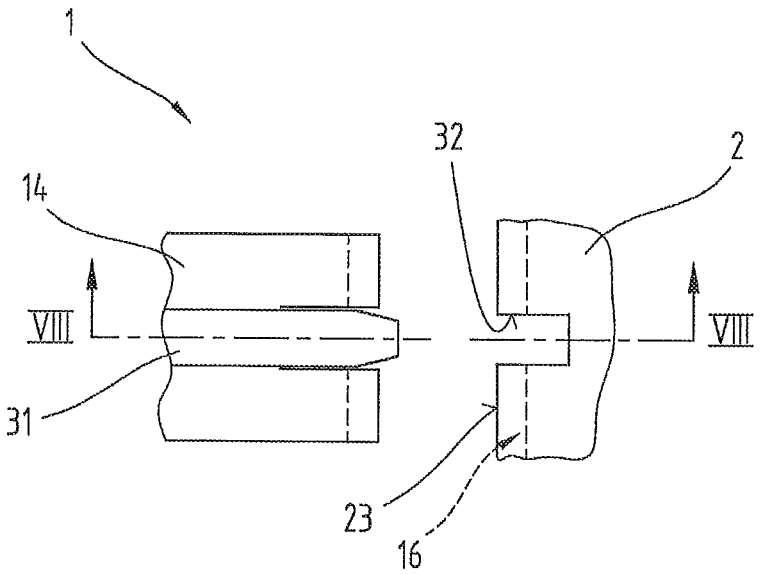
FIG. 7 shows a further embodiment of a tool handling system with a centering projection.
Figure 8:
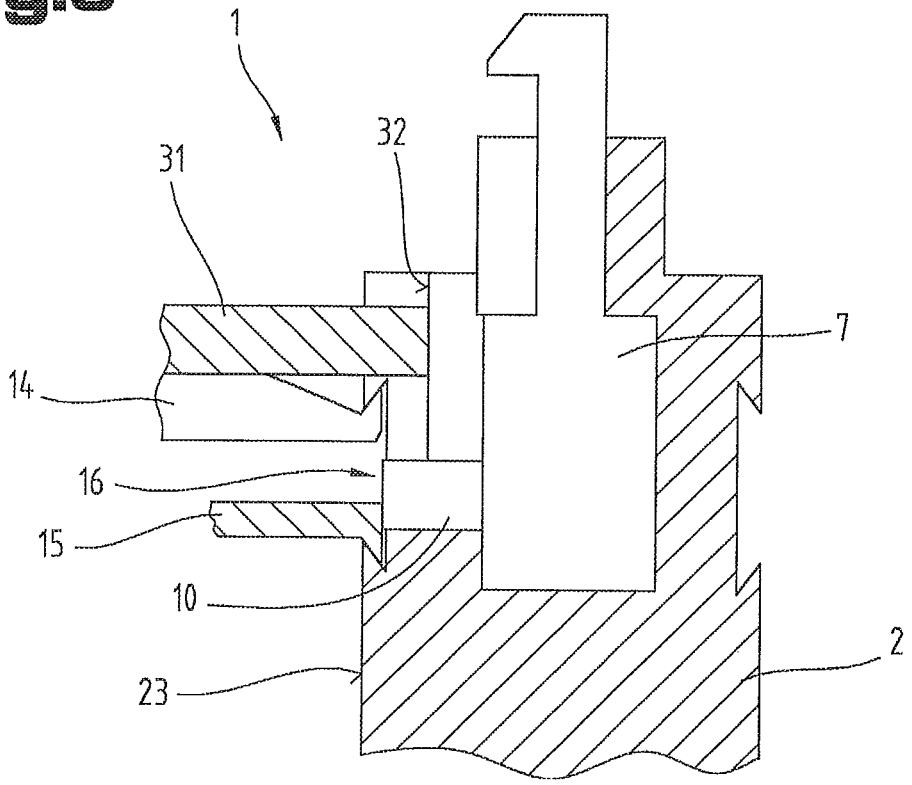
FIG. 8 shows a plan view of a tool handling system according to FIG. 7.

A further possible embodiment of the tool handling system 1 is shown in FIGS. 7 and 8, wherein the first gripper finger 14 is connected to a centering projection 31 or comprises the latter, wherein the latter interacts with a centering recess 32 on the bending tool 2 during the positioning of the gripper fingers 14, 15 in the gripping recess 16. In the plan view shown in FIG. 7 of such a gripper finger 14 a wedge-shaped design of the centering finger 31 is indicated which enables a simpler insertion into the centering recess 32. In addition or alternatively it is also possible for the centering recess 32 to be designed to have sloping surfaces, wherein this also enables the easier positioning of the gripper fingers 14, 15 in the gripping recess 16.

The centering recess 32 is designed in the shown embodiment as a vertical slot in the outer tool surface 23 of the bending tool 2, however also alternative embodiments of such a centering recess 32 and centering projection 31 are possible, for example in the form of a conical design.

Figure 9:
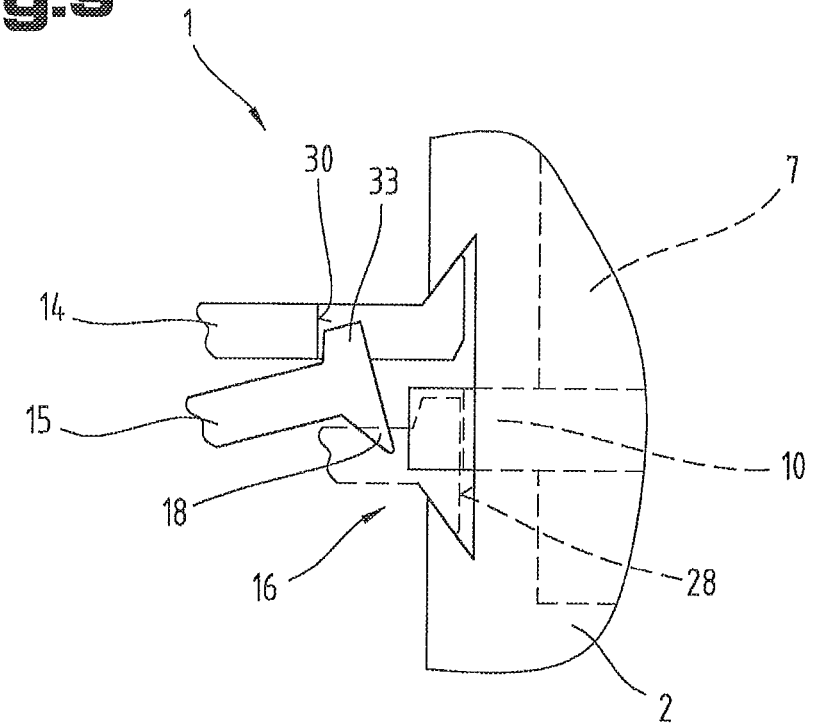
FIG. 9 shows a tool handling system with an actuating extension on the adjustable gripper finger.

FIG. 9 shows a further and possibly independent embodiment of the tool handling system, wherein the same reference numerals and component names have been used for the same parts as in the preceding FIGS. 1 to 8. To avoid unnecessary repetition reference is made to the detailed description in the preceding FIGS. 1 to 8.

FIG. 9 shows a further embodiment of a tool handling system 1, in which the adjustable second gripper finger 15 comprises an actuating extension 33, which projects in the release position into a recess 30 on the first gripper finger 14. This provides further choice with regard to the arrangement of the actuating element 10 inside the gripping recess 16 and can be used advantageously in particular in combination with the offset 29 described by the example embodiment in FIG. 4. By means of the actuating extension 33, which is oriented in the opposite direction of the gripping projection 18, in the gripping position shown by dashed lines there is an enlarged end surface 28, which can be used for contacting the actuating element 10.

The example embodiments show possible embodiment variants of the tool handling system 1, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, also individual features or combinations of features from the shown and described different embodiments can represent in themselves independent solutions according to the invention.

The problem addressed by the independent solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1; 2; 3; 4; 5; 6; 7; 8; 9 can form the subject matter of independent solutions according to the invention. The objectives and solutions according to the invention relating thereto can be taken from the detailed descriptions of these figures.

Finally, as a point of formality, it should be noted that for a better understanding of the structure of the tool handling system 1 device, the latter and its components have not been represented true to scale in part and/or have been enlarged and/or reduced in size.

| List of reference numerals | |
|---|---|
| 1 | tool handling system |
| 2 | bending tool |
| 3 | tool mounting |
| 4 | fixing device |
| 5 | clamping element |
| 6 | clamping recess |
| 7 | locking device |
| 8 | locking element |
| 9 | locking recess |
| 10 | actuating element |
| 11 | gripper |
| 12 | gripper base body |
| 13 | gripper longitudinal axis |
| 14 | gripper finger |
| 15 | gripper finger |
| 16 | gripping recess |
| 17 | end section |
| 18 | gripping projection |
| 19 | undercut |
| 20 | articulation |
| 21 | gripping groove |
| 22 | actuating direction |
| 23 | outer tool surface |
| 24 | groove base |
| 25 | pivot joint |
| 26 | pivot axis |

-continued

| List of reference numerals | |
|---|---|
| 27 | end surface |
| 28 | end surface |
| 29 | offset |
| 30 | recess |
| 31 | centering projection |
| 32 | centering recess |
| 33 | actuating extension |

The invention claimed is:

1. A tool handling system, comprising a bending tool with a gripping recess and a locking device cooperating with a tool mounting, wherein the locking device can be deactivated by an actuating element arranged and accessible in the gripping recess, as well as a gripper for manipulating the bending tool and the actuating element, with a gripper base body having at least first and second gripper fingers aligned in the direction of a gripper longitudinal axis which at their end sections relative to the gripper longitudinal axis have transversely outwardly pointing and approximately opposite gripping projections for engaging in opposite undercuts in the gripping recess, wherein the first gripper finger is fixed on the gripper base body and the second gripper finger is adjustable by an articulation on the gripper base body between an approached release position, relative to the first gripper finger, and a remote gripping position, wherein with the first gripper finger positioned fully in the gripping recess the first gripper finger and the second gripper finger in the release position do not contact the actuating element or do not deactivate the locking device and the second gripper finger in the gripping position contacts the actuating element or deactivates the locking device (7).

2. The tool handling system as claimed in claim 1, wherein the end surface of the second gripper finger is set back in the release position relative to the end surface of the first gripper finger in the direction of the gripper longitudinal axis by an offset.

3. The tool handling system as claimed in claim 1, wherein the end section of the first gripper finger has on its end surface a recess for the actuating element.

4. The tool handling system as claimed in claim 1, wherein the gripping recess is designed as a gripping groove and the undercuts run along the gripping groove, and the gripping projections comprise strips parallel to one another and extend perpendicular to the gripper longitudinal axis.

5. The tool handling system as claimed in claim 1, wherein the actuating element is arranged in the gripping recess approximately centrally between the undercuts, and the actuating direction of the actuating element runs approximately parallel to the gripper longitudinal axis.

6. The tool handling system as claimed in claim 1, wherein the actuating element is arranged in one of the undercuts.

7. The tool handling system as claimed in claim 1, wherein the second gripper finger is mounted by a pivot joint about a pivot axis on the gripper base body.

8. The tool handling system as claimed in claim 1, wherein the second gripper finger is mounted by a slide joint obliquely relative to the gripper longitudinal axis on the gripper base body.

9. The tool handling system as claimed in claim 1, wherein the second gripper finger comprises an actuating extension, which projects in the release position into a recess on the first gripper finger.

10. The tool handling system as claimed in claim 1, wherein the gripping projections are comprise strips parallel to one another and the likes the undercuts are designed to be parallel to one another and in the form of a dovetail.

11. The tool handling system as claimed in claim 2, wherein the offset of the second gripper finger in the release position relative to the end surface of the first gripper finger corresponds at least to a thickness dimension of the gripping projection on the first gripper finger in the direction of the gripper longitudinal axis.

12. The tool handling system as claimed in claim 1, wherein the first gripper finger is connected to a centering projection and on the bending tool a centering recess adjusted to the centering projection is formed.

13. The tool handling system as claimed in claim 1, wherein the second gripper finger comprises an offset bend in the direction of the first gripper finger.

14. A method for removing or inserting a bending tool on a tool mounting by a gripper, the method comprising:

providing the bending tool and the tool mounting, wherein the bending tool comprises a gripping recess and a locking device interacting with the tool mounting, wherein the locking device can be deactivated by an actuating element (10) arranged and accessible in the gripping recess, and wherein the gripper comprises at least one first gripper finger aligned in the direction of a gripper longitudinal axis and an adjustable second gripper finger, which at their end sections comprise gripping projections pointing outwards perpendicular to the gripper longitudinal axis and approximately opposite for gripping behind opposite first and second undercuts in the gripping recess, removing the bending tool by firstly moving the first gripper finger into engagement with the first undercut and thereby the adjustable second gripper finger does not contact the actuating element or does not deactivate the locking device and then moving the adjustable second gripper finger into engagement with the second undercut and thereby the adjustable second gripper finger contacts the actuating element or deactivates the locking device or inserting the bending tool by moving the adjustable second gripper finger out of engagement with the second undercut and in this way the actuating element is no longer contacted and the locking device is activated and afterwards moving the first gripper finger out of engagement with the first undercut of the gripping recess.

* * * * *